US008608866B2

(12) United States Patent
Francisco et al.

(10) Patent No.: US 8,608,866 B2
(45) Date of Patent: Dec. 17, 2013

(54) DETERGENT DISPENSER FOR IMPROVED DETERGENT REMOVAL

(75) Inventors: Virgil J. Francisco, Ayden, NC (US); Mark D. Montgomery, Greenville, NC (US); Jason M. Patterson, Kinston, NC (US); Michael Bryan Pike, Kinston, NC (US); Ramon Rodriguez, New Bern, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 13/308,948

(22) Filed: Dec. 1, 2011

(65) Prior Publication Data

US 2012/0138101 A1 Jun. 7, 2012

Related U.S. Application Data

(60) Provisional application No. 61/419,116, filed on Dec. 2, 2010.

(51) Int. Cl.
*B08B 3/00* (2006.01)

(52) U.S. Cl.
USPC ..... 134/56 D; 134/93; 134/99.2; 134/104.1; 134/117; 68/17 R; 68/12.18; 68/17 A; 68/207; 222/129; 222/651; 222/160; 222/173

(58) Field of Classification Search
USPC ..... 134/56 D, 57 D, 58 D, 93, 104.1, 114, 134/117, 6, 92; 222/651, 129, 160, 173, 222/504, 511, 109, 132, 181.3, 184, 517; 68/17 R, 12.18, 12.02, 12.05, 12.12, 68/12.16, 13 R, 17 A, 207
See application file for complete search history.

(56) References Cited

U.S. PATENT DOCUMENTS 3,402,853 A 9/1968 Perl
3,850,185 A 11/1974 Guth (Continued)

FOREIGN PATENT DOCUMENTS

DE 2 038 324 A1 2/1972
DE 36 23 027 A1 1/1988

(Continued)

OTHER PUBLICATIONS

KitchenAid photograph taken Jan. 18, 2011 at Lowes Home Improvement Store.

(Continued)

*Primary Examiner* — Michael Barr
*Assistant Examiner* — Thomas Bucci
(74) *Attorney, Agent, or Firm* — Alston & Bird LLP

(57) ABSTRACT

Embodiments of the present invention are related to a detergent dispenser configured to attach to an interior surface of a dishwasher door. The detergent dispenser may comprise a reservoir configured to hold detergent, wherein a portion of the upper wall of the reservoir has been removed to reduce a cross-sectional length thereof such that water flowing down the dishwasher door is encouraged into the reservoir. The detergent dispenser may also comprise a dispenser door comprising a closed configuration and an open configuration, wherein the dispenser door is configured to cover the reservoir in the closed configuration. The detergent dispenser may be configured to encourage water flowing down the interior surface of the dishwasher door to enter the reservoir when the dispenser door is in the open or closed configuration.

20 Claims, 14 Drawing Sheets

(56) References Cited

U.S. PATENT DOCUMENTS

| | | | | |
|---|---|---|---|---|
| 3,975,931 | A | 8/1976 | Bischkopf | |
| 4,805,647 | A | 2/1989 | Marks | |
| 6,622,896 | B2 * | 9/2003 | Hegeman et al. | 222/651 |
| 7,210,315 | B2 | 5/2007 | Castelli | |
| 7,337,635 | B2 | 3/2008 | Cerruti et al. | |
| 7,749,335 | B2 * | 7/2010 | Simmons et al. | 134/56 D |
| 2004/0244434 | A1 | 12/2004 | Zucholl et al. | |
| 2010/0089425 | A1 | 4/2010 | Classen et al. | |

FOREIGN PATENT DOCUMENTS

| | | | | |
|---|---|---|---|---|
| DE | 36 25 124 | A1 | 2/1988 | |
| DE | 38 07 715 | A1 | 9/1989 | |
| DE | 40 00 378 | A1 | 7/1991 | |
| DE | 198 57 647 | A1 | 6/2000 | |
| DE | 10 2005 025 391 | A1 | 12/2006 | |
| EP | 1 935 319 | A2 | 6/2008 | |
| GB | 2 215 992 | A | 10/1989 | |
| GB | 2215992 | A * | 10/1989 | A47L 15/42 |
| WO | WO 2006/069827 | A1 | 7/2006 | |
| WO | WO 2009/022223 | A2 | 2/2009 | |
| WO | WO 2010/038189 | A1 | 4/2010 | |
| WO | WO 2010038189 | A1 * | 4/2010 | A47L 15/44 |

OTHER PUBLICATIONS

Whirlpool—Maytag photograph taken Jan. 18, 2011 at Lowes Home Improvement Store.

* cited by examiner

DETERGENT DISPENSER FOR IMPROVED DETERGENT REMOVAL

CROSS REFERENCE TO RELATED APPLICATIONS

The present application claims priority to U.S. Provisional Application No. 61/419,116 filed Dec. 2, 2010, the contents of which are hereby incorporated herein in its entirety by reference.

FIELD OF THE INVENTION

Embodiments of the present invention relate to dishwashing appliances and, more particularly, to detergent dispensers and removal of detergent from detergent dispensers.

BACKGROUND

Dishwashers have become an integral part of everyday household use. A typical dishwasher uses detergent, released from a detergent dispenser, in combination with wash water to clean dishware contained therein. A user deposits detergent into a detergent dispenser reservoir, closes the detergent dispenser door, closes the dishwasher door, and then runs the dishwasher cycle. During the cycle the detergent dispenser door opens causing detergent to flow out into the dishwasher tub to be mixed with water.

However, with reference to FIG. 2, some detergent often remains in the dispenser. Therefore, some dishwashers employ spray arms to spray water jets into the dispenser reservoir to force the detergent into the tub. The variety of dishware and the randomness of loading patterns used by the consumer may, however, cause this technique to have reduced effectiveness. For example, sometimes, users wash dishware, such as a soup pot, which are large enough to block the spray arm jets that were designed to remove detergent from the detergent dispenser. When the jets are sufficiently blocked, the detergent may stay in the dispenser instead of being used in an appropriate manner during the total wash cycle.

Detergent that remains in the detergent dispenser is ineffective in cleaning the dishware and may cause subsequent rinse cycles to become ineffective due to detergent contamination. Furthermore, eating from dishware with detergent left on it may result in sickness. Thus, there is a need for techniques for improving the removal of detergent from the dispenser during operation of the dishwasher.

SUMMARY OF THE INVENTION

Embodiments of the present invention provide systems, apparatus, and methods for improved removal of detergent from a detergent dispenser in a dishwasher.

An exemplary embodiment of the present invention is a dishwasher comprising a tub and a door hingedly connected to the tub and configured to pivot between an open position and a closed position, wherein the door further comprises an interior surface configured to face the tub when the door is in the closed position. The dishwasher further comprises at least one spray arm configured to provide water within the tub and a detergent dispenser positioned on the interior surface of the door. The detergent dispenser comprises a reservoir configured to contain detergent therein, wherein at least a portion of an upper wall of the reservoir is removed to reduce a cross-sectional length thereof such that water flowing down the interior surface of the dishwasher door is encouraged into the reservoir.

In some embodiments, the detergent dispenser further comprises a dispenser door configured to move between a closed configuration and an open configuration. The dispenser door may be further configured to cover the reservoir in the closed configuration, and the detergent dispenser may be configured to encourage water flowing down the interior surface of the door into the reservoir when the dispenser door is in the open configuration. In other embodiments, the detergent dispenser is configured to encourage water flowing down the interior surface of the door into the reservoir when the dispenser door is in the closed configuration.

In one aspect, the dispenser door is configured to cover the reservoir in the closed configuration to create a water-tight seal therebetween. In addition, the dispenser door may include a rib configured to engage the dispenser reservoir in the closed configuration to create a water-tight seal therebetween and disengage the dispenser reservoir in the open configuration to allow water flowing down the interior surface of the door to enter the dispenser reservoir.

In some embodiments, the detergent dispenser further comprises a curved surface extending at least partially between the interior of the dishwasher door and the reservoir and configured to encourage water flowing down the interior surface of the door into the detergent dispenser. In some embodiments, the reservoir comprises a sloped upper surface configured to encourage water into the reservoir and a sloped lower surface configured to encourage detergent out of the reservoir.

In some embodiments, the reservoir of the detergent dispenser may define a width and the removed portion of the upper wall may define a width. Additionally, the width of the removed portion of the upper wall may be less than the width of the reservoir. In some embodiments, the removed portion of the upper wall may define a width between 86-100% of the width of the upper wall. In one exemplary embodiment, the removed portion is between about 2 and 2.3 inches. In some embodiments, the upper wall may comprise a pair of radial edges disposed on opposite sides of the reservoir from one another. Additionally, the width of the removed portion may extend between the radial edges.

Another exemplary embodiment of the present invention is a detergent dispenser for a dishwasher. The detergent dispenser comprises a reservoir configured to contain detergent therein, wherein at least a portion of the upper wall of the reservoir has been removed to reduce a cross-sectional length thereof such that water flowing down the interior surface of the dishwasher door is encouraged into the reservoir. In some embodiments, the reservoir of the detergent dispenser may comprise a sloped upper surface configured to encourage water into the reservoir.

In some embodiments, the detergent dispenser further comprises a dispenser door configured to move between a closed configuration and an open configuration and to cover the reservoir in the closed configuration. The detergent dispenser may be configured to encourage water flowing down the interior surface of the dishwasher door into the reservoir when the dispenser door is in the open configuration. Alternatively, the detergent dispenser may be configured to encourage water flowing down the interior surface of the door into the reservoir when the dispenser door is in the closed configuration.

In yet another exemplary embodiment, a detergent dispenser for a dishwasher is provided. The detergent dispenser comprises a reservoir configured to contain detergent therein. The reservoir comprises a sloped upper surface configured to encourage water into the reservoir and a sloped lower surface configured to encourage detergent out of the reservoir.

Other embodiments of the present invention include a method for operating a dishwasher, the method comprises providing a dishwasher comprising a tub and a door hingedly connected to the tub and configured to pivot between an open position and a closed position, wherein the door further comprises an interior surface configured to face the tub when the door is in the closed position. The dishwasher further comprises at least one spray arm configured to provide water within the tub and a detergent dispenser positioned on the interior surface of the door and comprising a reservoir configured to contain detergent therein, wherein at least a portion of the upper wall of the reservoir has been removed to reduce a cross-sectional length thereof. The method further comprises configuring the dishwasher such that in operation water provided to the tub through the at least one spray arm flows down the interior surface of the dishwasher door and is encouraged into the reservoir.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 10:
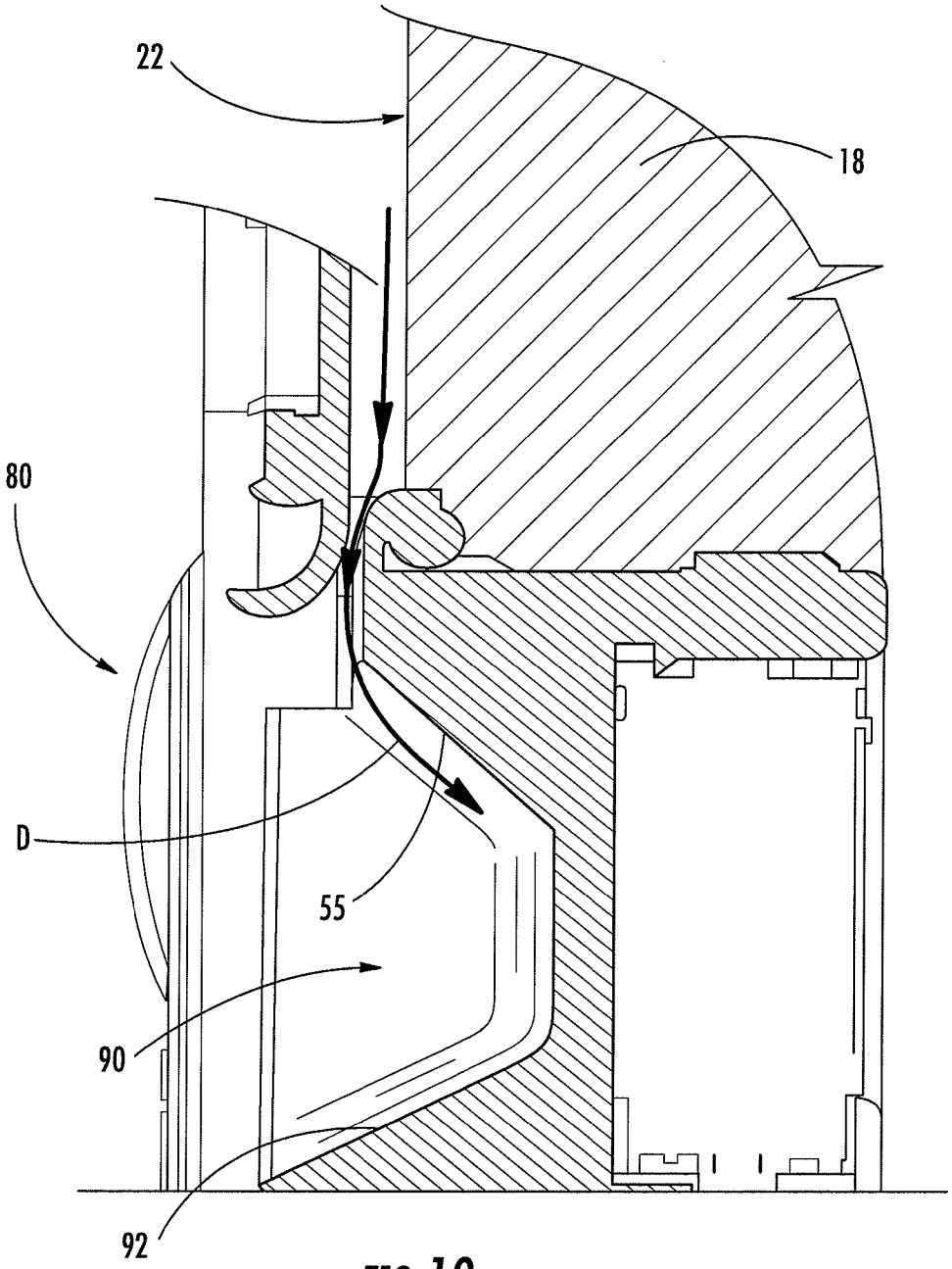
Figure 11:
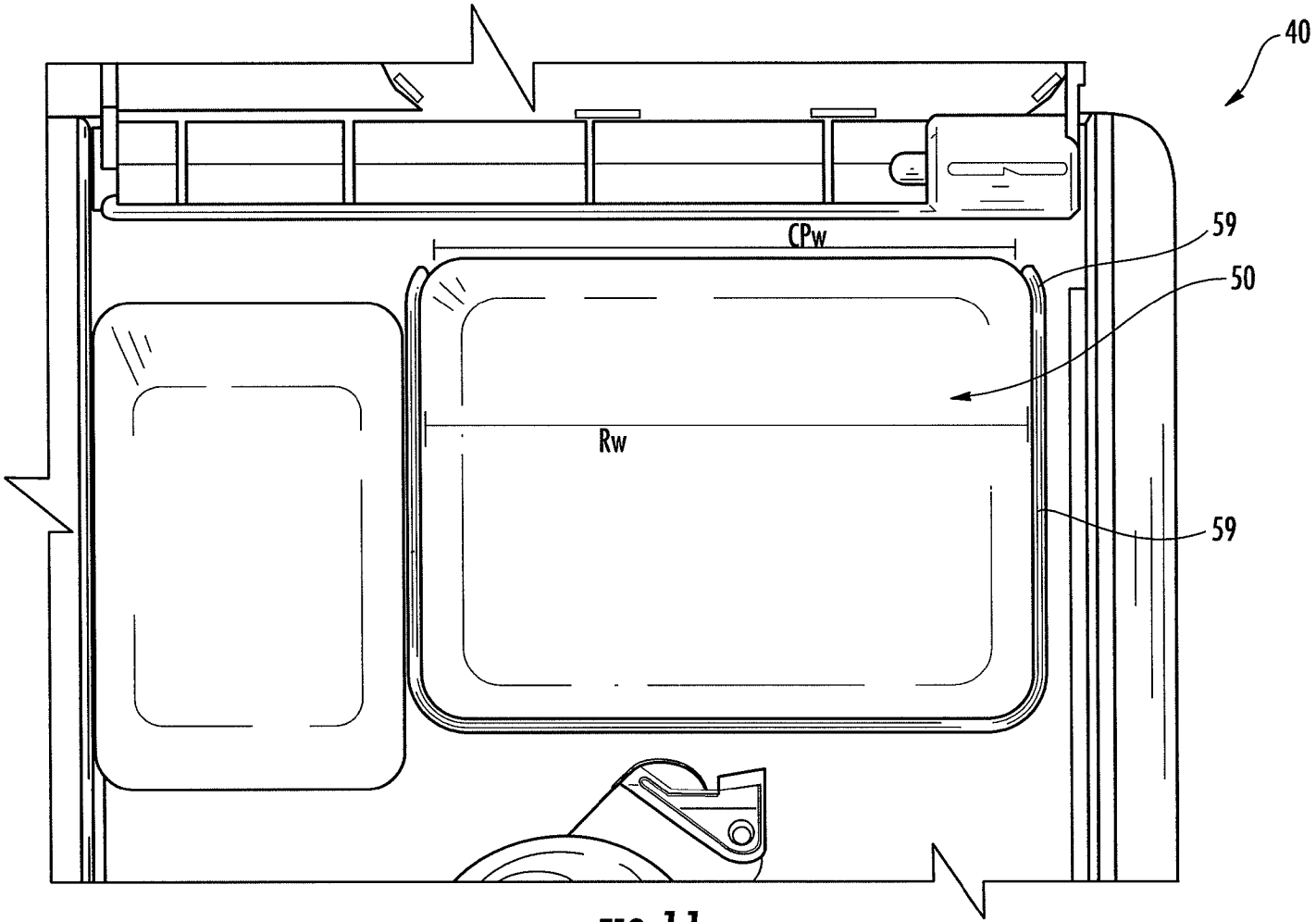
Figure 11A:
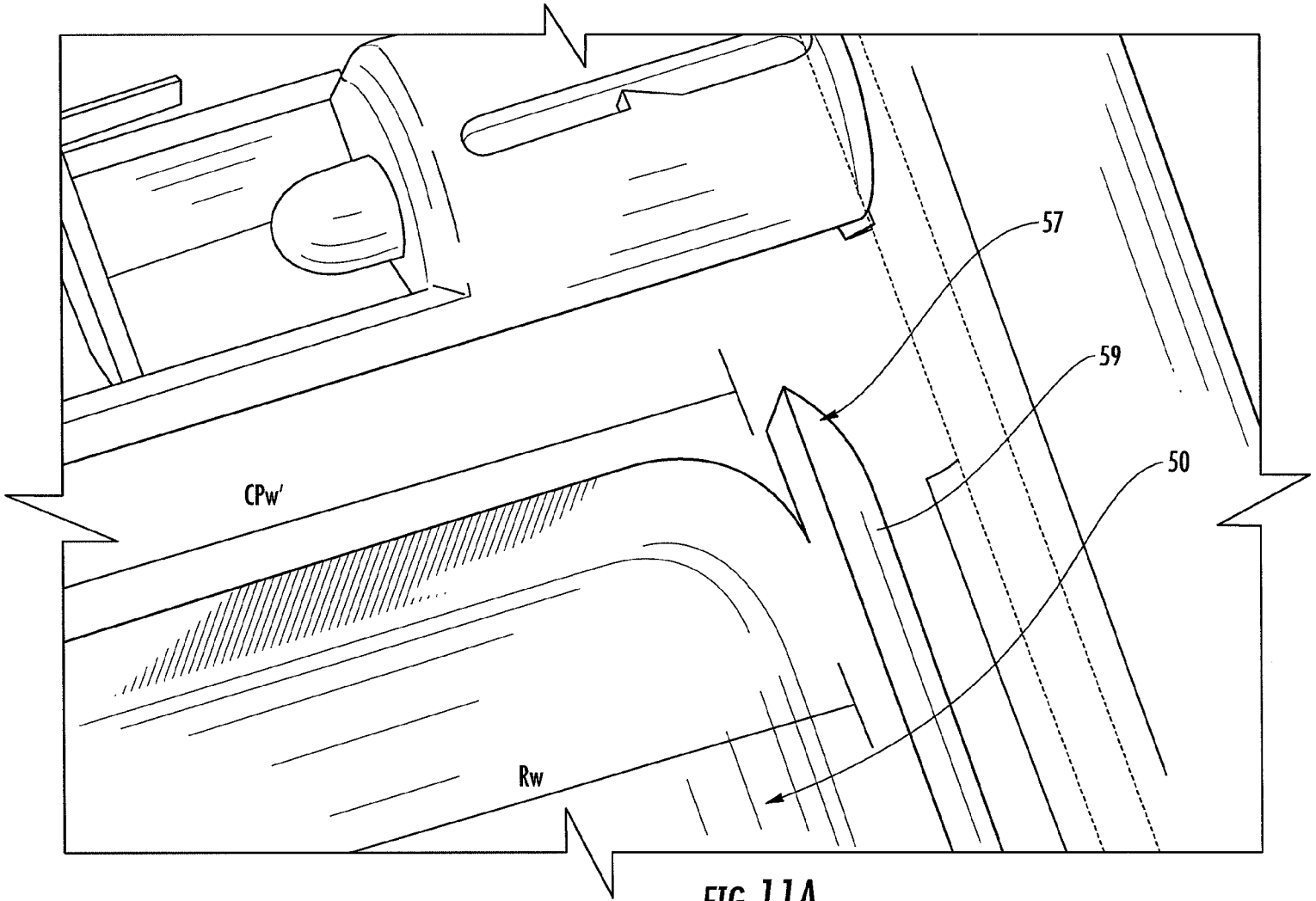
Figure 11B:
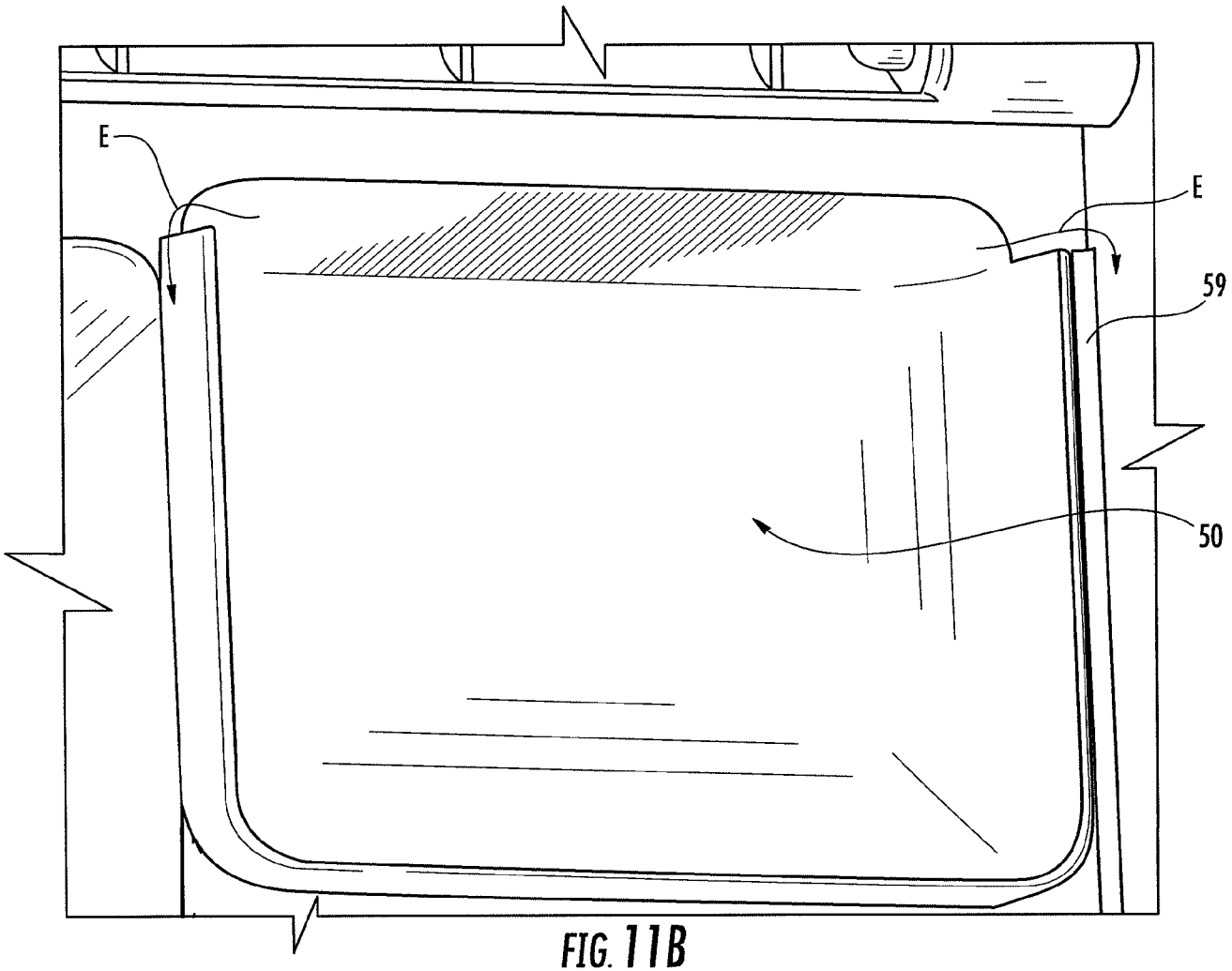
Figure 11C:
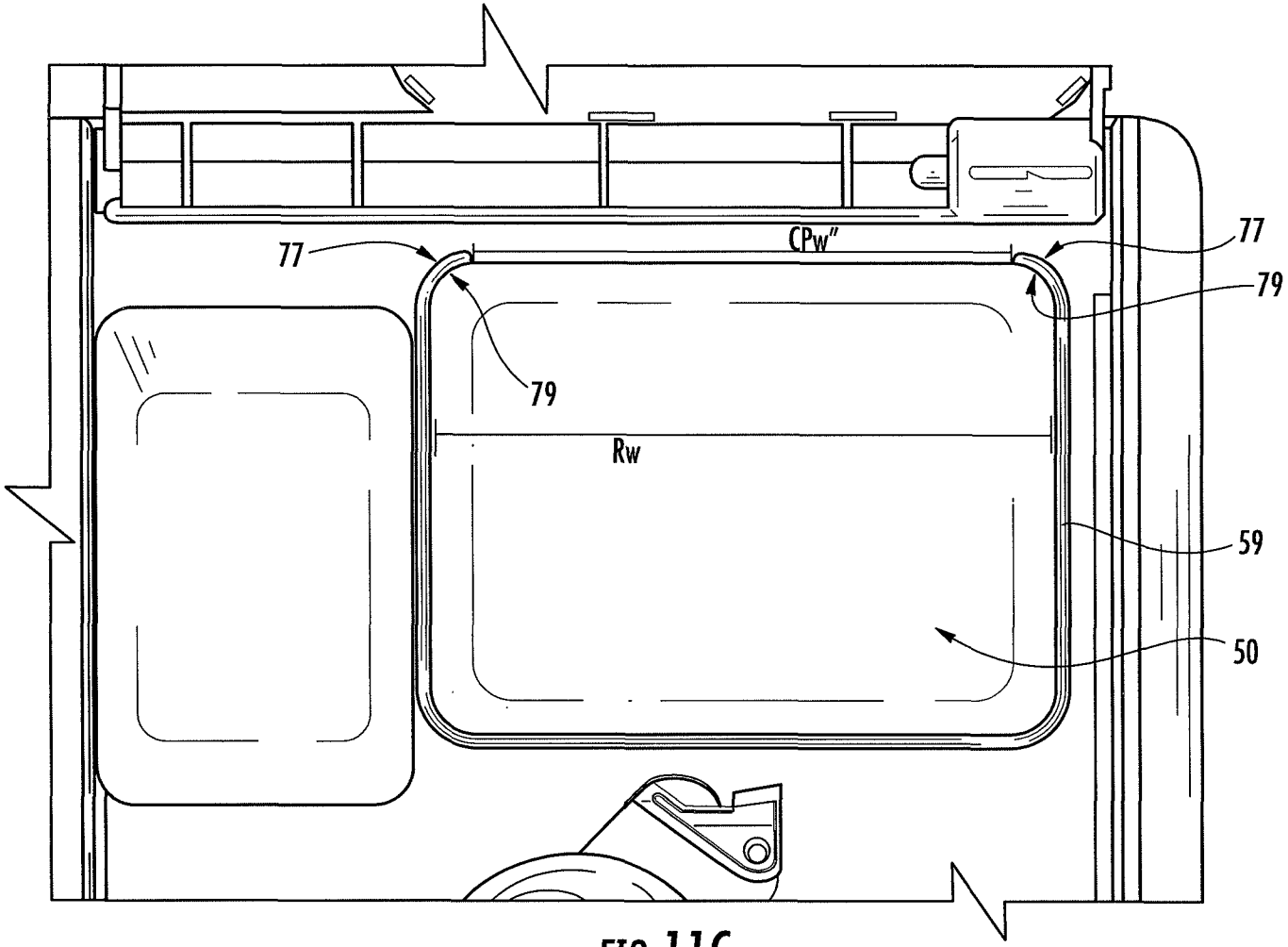

FIG. 10 is an enlarged cross-sectional side view of another embodiment of a detergent dispenser in an open configuration in accordance with some embodiments discussed herein FIG. 11 is an enlarged view of an exemplary embodiment of a detergent dispenser, wherein a portion of the upper wall with a width less than the width of reservoir has been removed, in accordance with some embodiments discussed herein;

FIG. 11A is an enlarged view of a portion of an exemplary detergent dispenser, wherein a portion of the upper wall with a width substantially equal to the width of reservoir has been removed, in accordance with some embodiments discussed herein;

FIG. 11B is an enlarged view of a portion of another exemplary detergent dispenser, wherein a portion of the upper wall with a width substantially equal to the width of reservoir has been removed, in accordance with some embodiments discussed herein; and FIG. 11C is an enlarged view of a portion of another exemplary detergent dispenser, wherein a portion of the upper wall with a width less than the width of reservoir has been removed, in accordance with some embodiments discussed herein.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
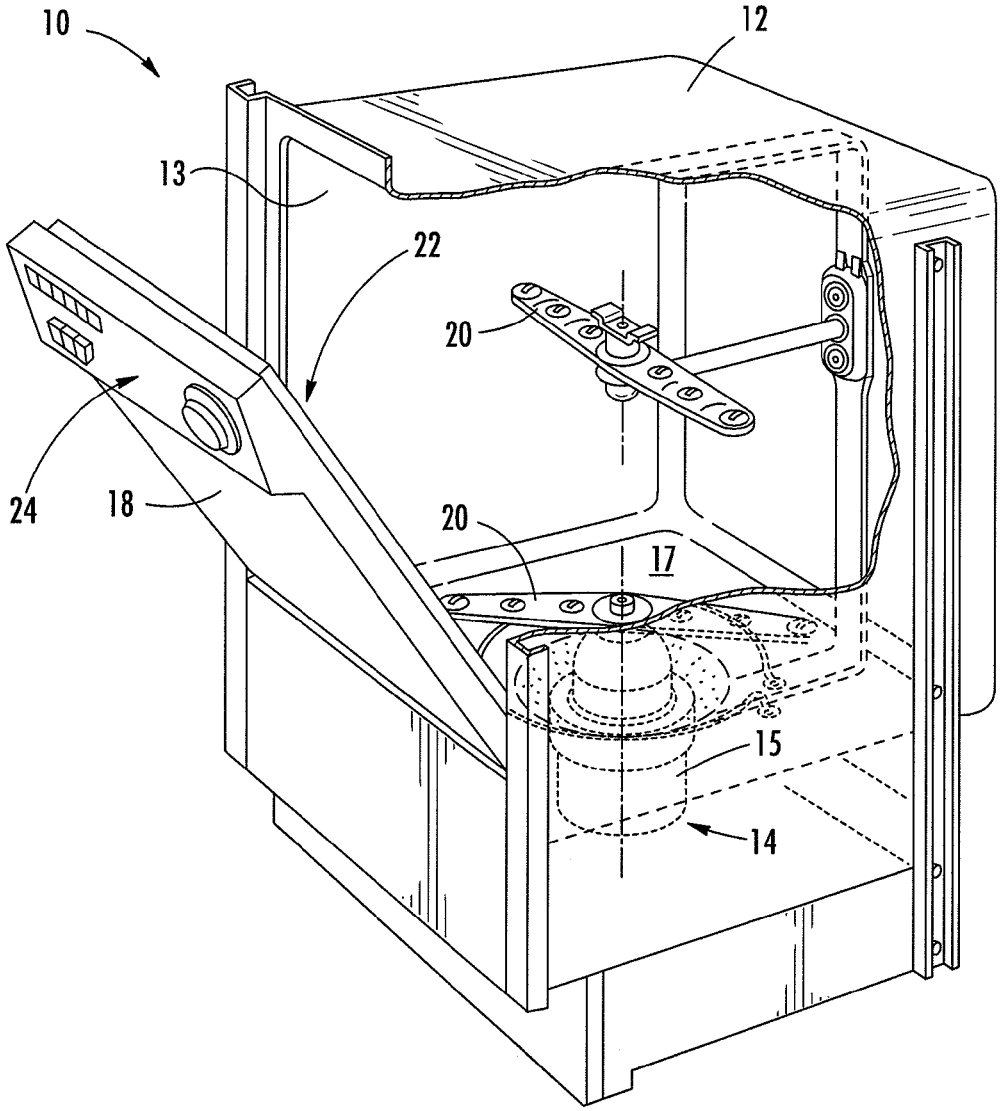
FIG. 1 is a perspective view of a dishwasher in accordance with some embodiments discussed herein.
Figure 2:
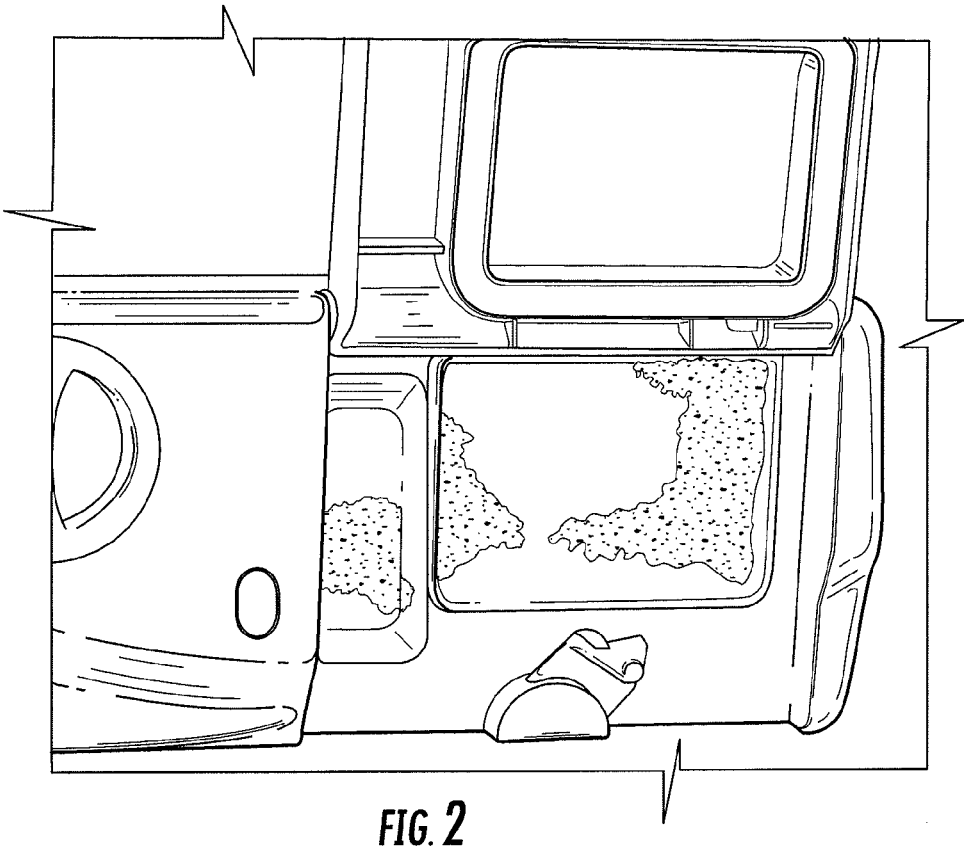
FIG. 2 is a perspective view of a detergent dispenser in an open configuration and containing residue detergent left over after a wash cycle.

FIG. 1 illustrates one example of a dishwasher 10 capable of implementing various embodiments of the present invention. Such a dishwasher 10 typically includes a tub 12 (partly broken away in FIG. 1 to show internal details), having a plurality of walls (e.g., side wall 13) for forming an enclosure in which dishes, utensils, and other dishware may be placed for washing. As known in the art, the dishwasher 10 may also include slidable bottom and upper racks (not shown) for holding the dishes, utensils, and dishware.

A door 18 may be pivotably engaged with the tub 12 to selectively permit access to the interior of the tub 12. The door 18 may close to cover and seal the tub 12 when the dishwasher 10 is in operation. The door 18 comprises an interior surface or side 22 configured to face the tub 12 of the dishwasher 10 when sealed and an opposing external surface or side 24.

The tub 12 may define a sump 14, in which wash water or rinse water is collected, typically under the influence of gravity, wherein the sump 14 may cooperate with a bottom wall 17 to enclose the dishwasher in the tub 12. The wash/rinse water may be pumped by a sump pump 15 out of the sump 14 to various spray arms 20 mounted in the interior of the tub 12 for spraying the wash/rinse water, under pressure, onto the dishes, utensils, and other dishware contained therein.

The interior side 22 of the dishwasher 10 may comprise a detergent dispenser designed to open to release detergent into the tub 12 during operation of the dishwasher. The wash water will mix with the detergent and be used to clean the dishware contained in the tub 12.

Embodiments of the present invention provide techniques for improving the removal of detergent from the detergent dispenser. In particular, embodiments of the present invention take advantage of water running down the interior side 22 of the dishwasher door 18 for removing detergent, wherein the water originates from one or more upper spray arms 20 and continuously runs down the sides 13 of the tub 12 and the door 18.

Figure 3:
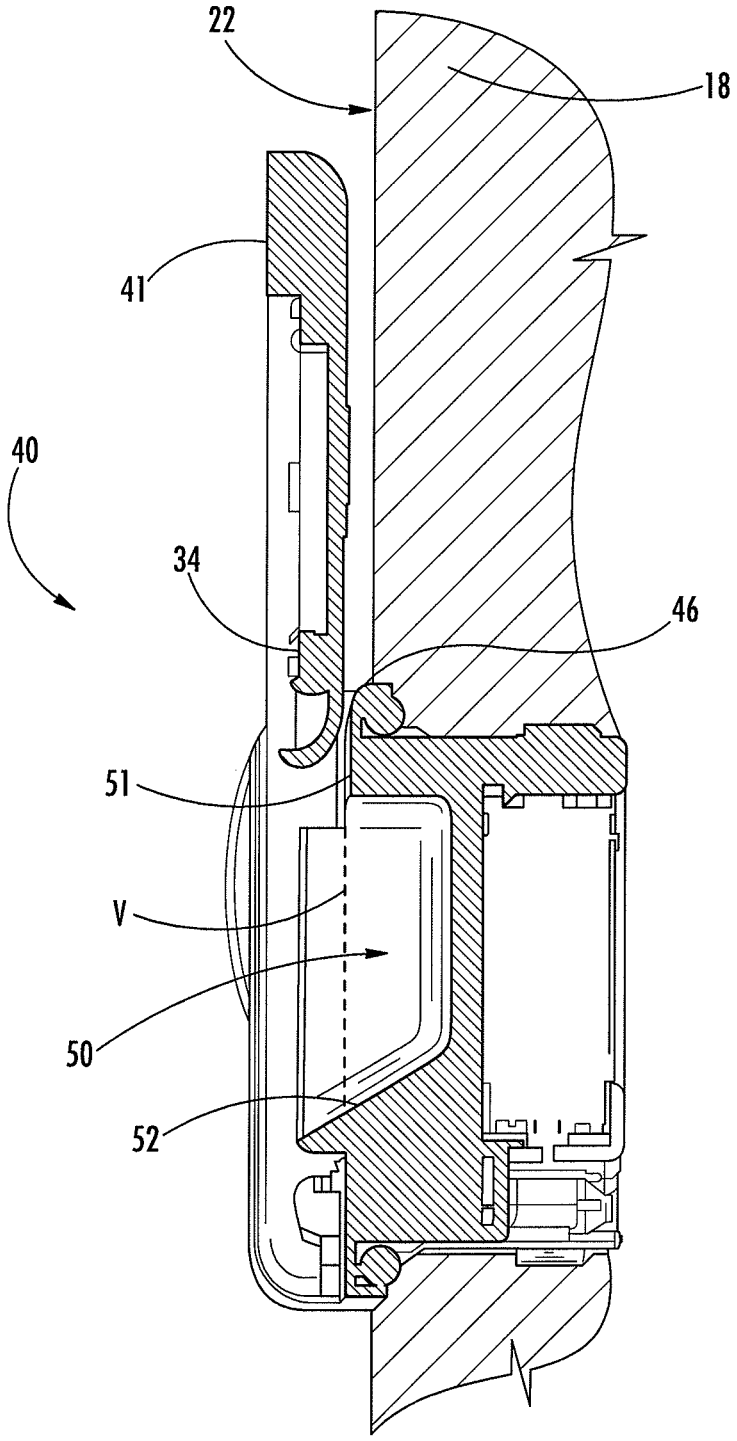
FIG. 3 is a cross-sectional side view of a detergent dispenser in an open configuration in accordance with some embodiments discussed herein.

An example embodiment of the present invention is shown in FIG. 3. The detergent dispenser 40 is configured to interact with and utilize wash water running down the interior side 22 of the dishwasher door 18 for detergent removal.

The detergent dispenser 40 is configured to be positioned on the interior side 22 of the dishwasher door 18. The detergent dispenser 40 could be coupled to the interior side 22 of the dishwasher door 18 or integrally formed therewith. The detergent dispenser 40 comprises a dispenser door 41 and a dispenser reservoir 50. The dispenser reservoir 50 is configured to receive and contain the detergent therein. In general, the dispenser reservoir 50 includes a cavity formed of a plurality of surfaces that define a volume sufficient for receiving the detergent therein and containing the detergent therein when the dispenser door 41 is closed. The dispenser door 41 is configured to close and cover the dispenser reservoir 50 thereby containing the detergent in the dispenser reservoir 50 while the dishwasher door 18 is vertically displaced in a closed position. The dispenser door 41 is also configured to open, usually during a wash cycle of the dishwasher, to release the detergent held in the dispenser reservoir 50. While the depicted embodiments detail the dispenser door 41 being configured to pivot between a closed configuration and an open configuration, other configurations may be employed to facilitate closing and opening of the dispenser door 41 (e.g., sliding of the door, pivoting of the door around an axis perpendicular to the plane of the door, etc.). Additionally, in some embodiments, the dispenser door 41 may be configured to transition from a closed configuration (e.g., the closed configuration shown in FIG. 5) to a fully open configuration (e.g., the open configuration shown in FIG. 3). In some embodiments, the dispenser door 41 defines an open position generally parallel to the interior of the dishwasher door when disposed in a fully open configuration.

In the depicted embodiment, the dispenser reservoir 50 may further comprise a lower sloped surface 52. The lower slope 52 is angled to utilize the force of gravity when the detergent dispenser 40 is displaced in a vertical position (i.e., when the dishwasher door 18 is closed). The angle of the lower slope 52 encourages detergent to leave the dispenser reservoir 50 upon opening of the dispenser door 41.

Embodiments of the present invention may also remove shedding surfaces and or ledges from the detergent dispenser 40. These shedding surfaces or ledges would normally act to discourage water flow to the dispenser reservoir 50. In the depicted embodiment, the detergent dispenser 40 may be contoured to encourage water to enter the reservoir 50. For example, the dispenser 40 may be curved or otherwise contoured between the interior side 22 and the reservoir 50. In one embodiment, the detergent dispenser 40 may further comprise a curved top edge 46. The curved top edge 46 takes advantage of the cohesive nature of the water such that water running down the dishwasher door is encouraged into the dispenser reservoir 50 around the curve.

Figure 4:
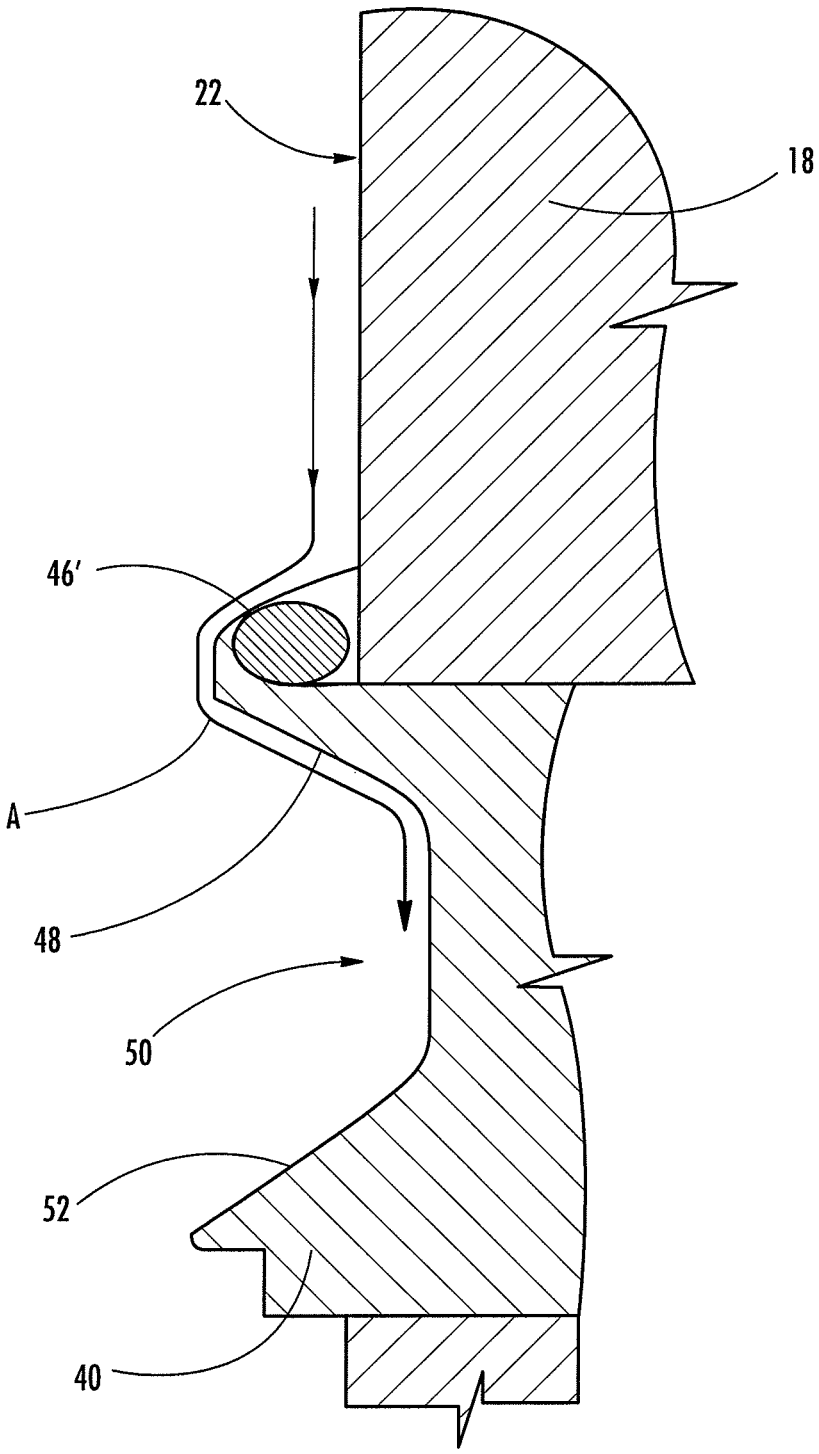
FIG. 4 is an enlarged cross-sectioned side view of a detergent dispenser in accordance with some embodiments discussed herein.

For example, in some embodiments, as shown in FIG. 4, the detergent dispenser 40 may have a pronounced curved top edge 46' such that water running down the interior side 22 of the dishwasher door 18 is encouraged to flow into the dispenser reservoir 50 along line A. Additionally or alternatively, the dispenser reservoir 50 may comprise a curved top portion 48 such that water is further encouraged into the dispenser reservoir 50. In the depicted embodiment, the curved top edge 46' and curved top portion 48 utilize the cohesive properties of water to encourage and/or direct the water running down the dishwasher door 18 into the dispenser reservoir 50.

Figure 5:
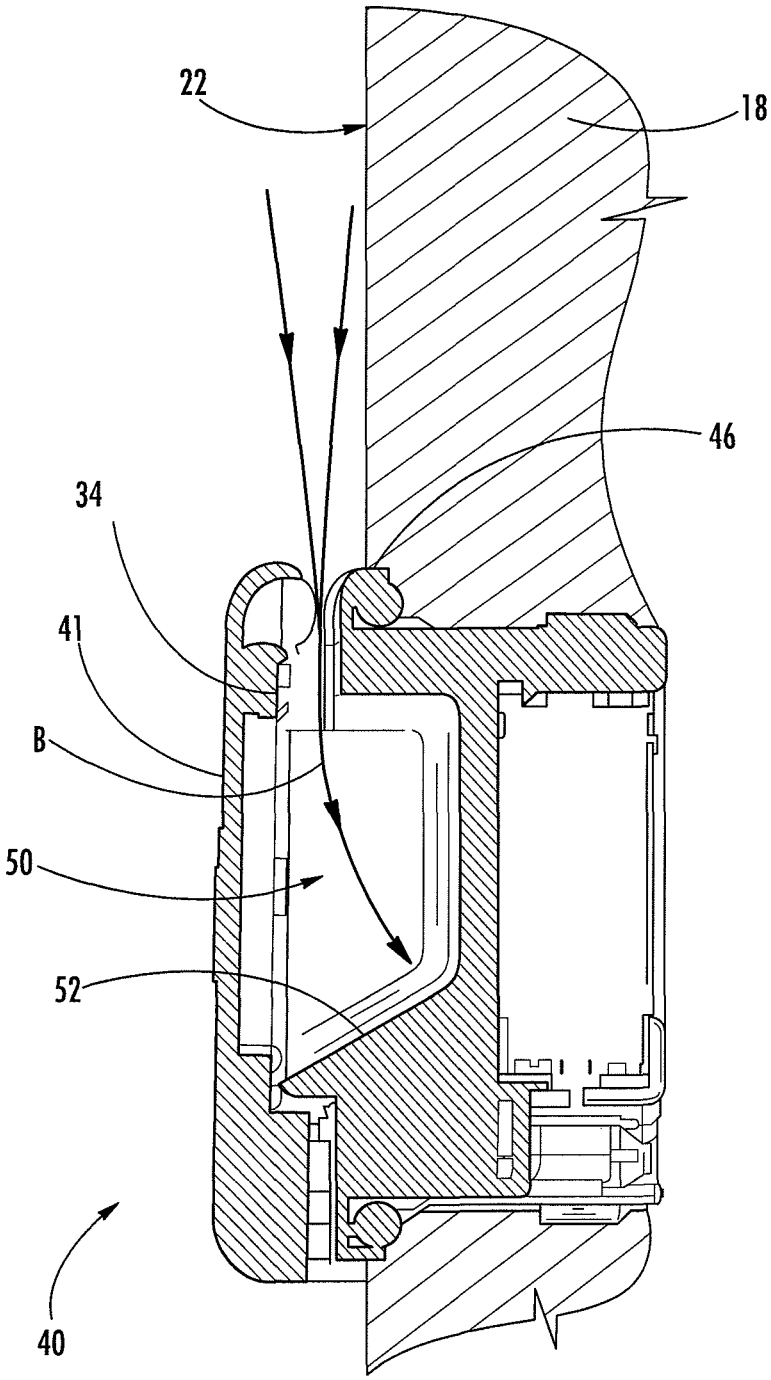
FIG. 5 is a cross-sectional side view of the detergent dispenser shown in FIG. 3 in a closed configuration in accordance with some embodiments discussed herein.
Figure 6:
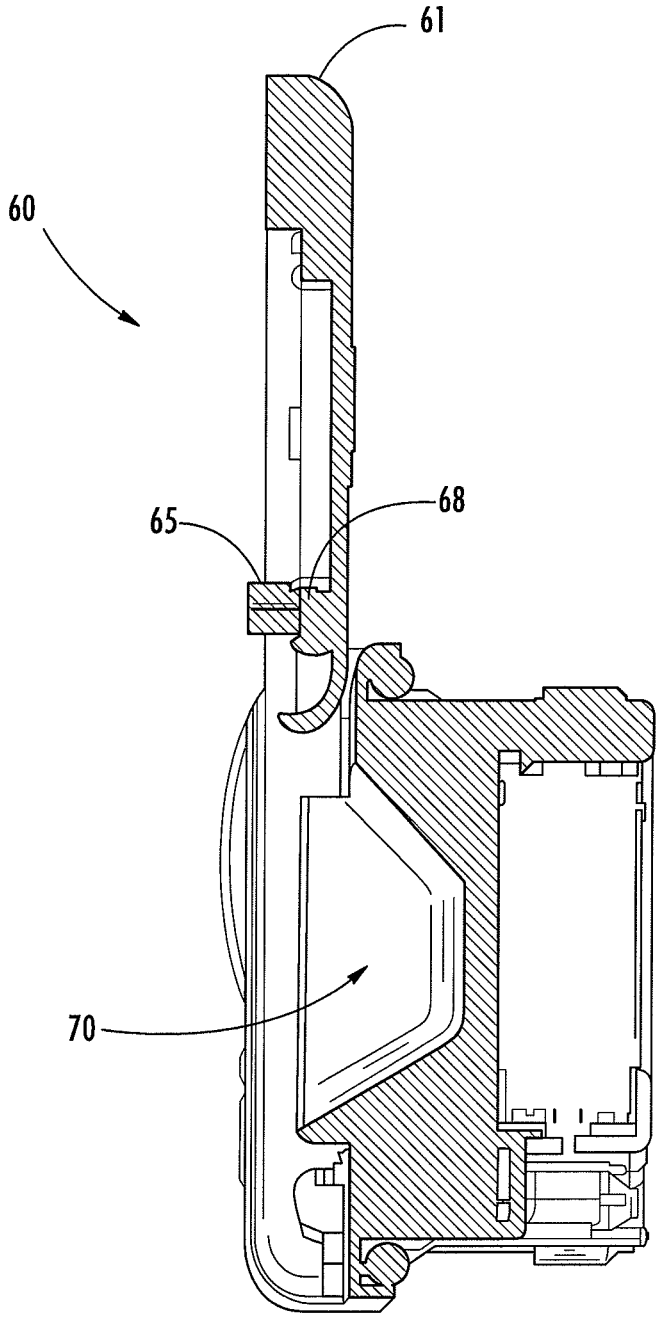
FIG. 6 is a cross-sectional side view of another embodiment of a detergent dispenser in an open configuration in accordance with some embodiments discussed herein.

In another embodiment, with reference to FIGS. 3-5, the detergent dispenser 40 is configured such that at least a portion of the upper wall or lip of a typical detergent dispenser's detergent reservoir is removed. In conventional detergent dispensers, the upper wall extends outwardly from an upper portion of the reservoir to engage a gasket 34 associated with the dispenser door 41 in order to create a water tight seal when the dispenser door is closed, and when the door is opened, the upper wall impedes flow into the reservoir. In contrast to conventional dispensers, the upper wall 53 of the detergent dispenser 50 is at least partially removed, which in one embodiment includes at least partially reducing a cross-sectional length "L" of the upper wall (as measured from a free end of the upper wall to an upper surface 51 of the reservoir 50), thereby encouraging water flowing down the dishwasher door 18 into the dispenser reservoir 50 as shown in FIGS. 3A, 4, and 5.

Figure 3A:
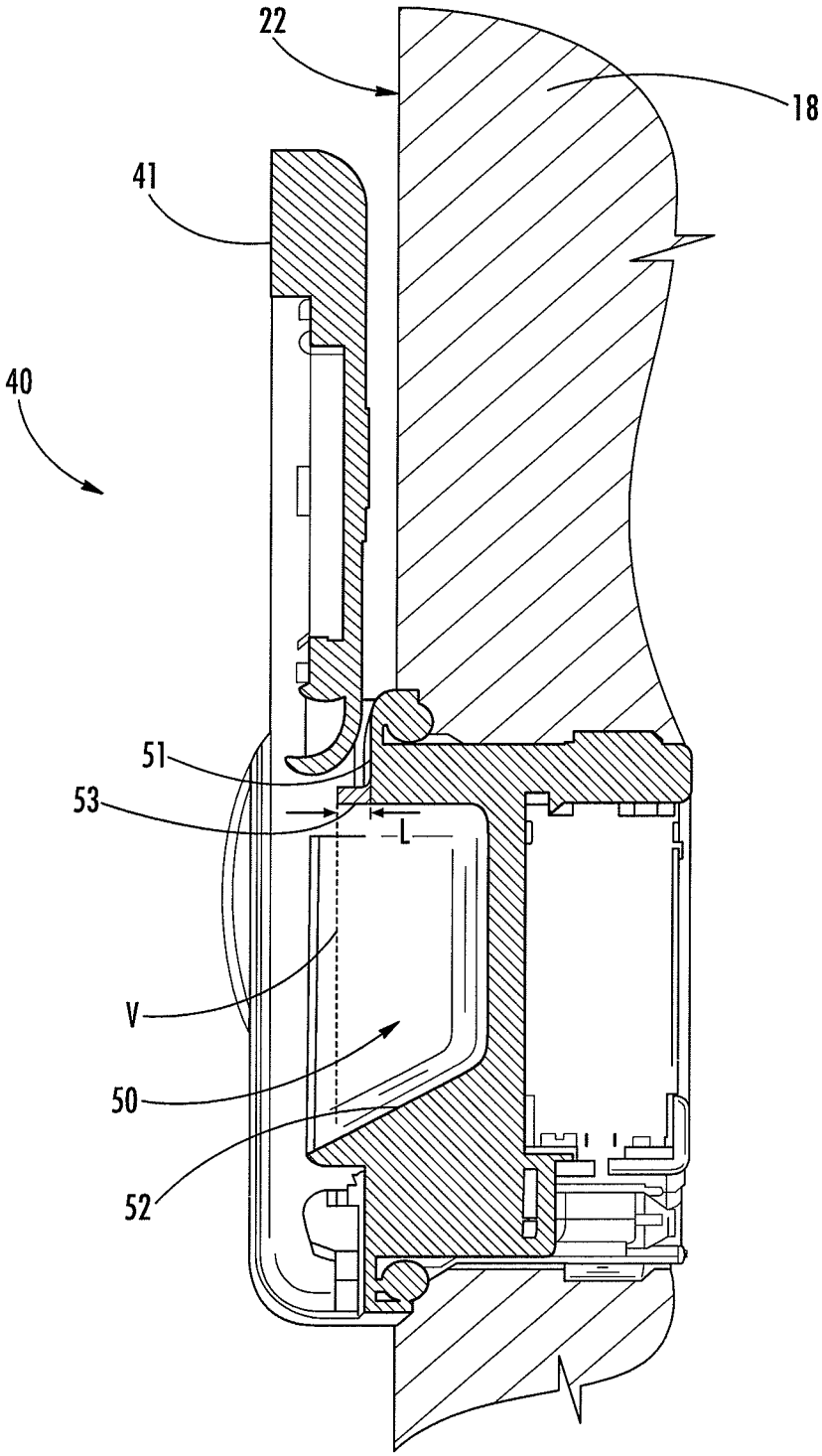
FIG. 3A is a cross-sectional side view of a detergent dispenser in an open configuration in accordance with some embodiments discussed herein.

In some embodiments, with reference to FIG. 3A, the cross-sectional length L of the upper wall 53 may be partially removed such that a vertical line "V" drawn from the free end of the upper wall 53 extends into the reservoir 50 and intersects lower slope 52. Thus, the upper wall 53 is shortened to encourage water flow into the reservoir 50 and in one embodiment, the upper wall may be completely removed (see FIG. 3). FIG. 3 demonstrates that when the upper wall 53 is removed, a vertical line V drawn from the upper surface 51 of the reservoir 50 likewise intersects the lower slope 52.

In some embodiments, removal of a portion of the upper wall may encourage water flowing down the interior surface of the dishwasher door into the detergent dispenser reservoir when the dispenser door is in the open configuration (e.g., shown in FIG. 10). Additionally or alternatively, in some embodiments, removal of a portion of the upper wall may encourage water flowing down the interior surface of the dishwasher door into the detergent dispenser reservoir when the dispenser door is in the closed configuration (e.g., shown in FIG. 5).

In some embodiments, with reference to FIG. 11, the reservoir 50 of the detergent dispenser 40 may comprise a wall 59 that extends outwardly from the interior surface of the dishwasher door around the reservoir 50. The wall 59 may be designed to retain detergent within the reservoir 50 while the dispenser door 41 is in the closed configuration, as well as provide a seal with the dispenser door. In some embodiments, removal of the upper wall includes removal of at least a portion of the wall 59. For example, the removed portion of the upper wall may create an opening within the wall 59 along the top edge of the reservoir 50. The opening (e.g., the removed portion of the upper wall) may define a width (e.g., the width ($CP_W$) shown in FIG. 11).

In some embodiments, the removed portion of the upper wall may define a width that is less than the width of the reservoir. In the depicted embodiment, the reservoir 50 defines a width ($R_W$) and the removed portion of the upper wall defines a width ($CP_W$). In some embodiments, the width ($R_W$) of the reservoir may be approximately 2.32 inches and the width ($CP_W$) of the removed portion of the upper wall may be approximately 2.2 inches. In some embodiments, the removed portion of the upper wall may define a width between about 2 and 2.3 inches. As the size of the detergent dispenser may vary, the removed portion of the upper wall may define a width between about 86-100% of the width of the reservoir according to one embodiment of the present invention.

In some embodiments, with reference to FIG. 11A, if the removed portion of the upper wall defines a width ($CP_W'$) substantially equal to the width ($R_W$) of the reservoir, the wall 59 may define a thin edge 57 at the upper portion of the reservoir. The thin edge 57, however, may be less desirable as it may be more prone to breakage during use and breakage of tooling during manufacturing. In some embodiments, to avoid creating the thin edge 57, a radial cut may be performed to remove the portion of the upper wall in order to maintain the thickness of the wall 59 (shown in FIG. 11). Thus, the upper wall 59 has a pair of radial edges and each radial edge is disposed on opposite sides of the reservoir 50 from one another. In this embodiment, the removed portion of the upper wall extends between the radial edges.

In some embodiments, with reference to FIG. 11B, the thin edge 57 may be removed to avoid breakage. However, in such embodiments, detergent held within the reservoir may leak around the wall 59 (e.g., along arrow "E") even when the dispenser door 41 is in the closed configuration and the dishwasher door 18 is in a vertical position.

As such, in some embodiments, defining a width of the removed portion of the upper wall that is slightly less than the width of the reservoir provides some advantages. For example, detergent is properly maintained within the reservoir until the dispenser door 41 transitions to the open configuration. Additionally, easily breakable thin edges (e.g., the thin edge 57 in FIG. 11A) are avoided.

Removal of too little of the upper wall, however, may provide some disadvantages. For example, in the depicted embodiment of FIG. 11C, the removed portion defines a width ($CP_W$") that is less than the width of the reservoir ($R_W$) but is less than the widths $CP_W$ and $CP_W$'. For example, the width $CP_W$" may be about 2 inches, while the width of the reservoir is about 2.32 inches. In such an embodiment, some detergent may become trapped within an area (e.g., area 79) behind a portion (e.g., portion 77) of the wall 59, thereby preventing complete removal of substantially all of the detergent from the reservoir. In particular, water flowing down the interior of the dishwasher door and into the detergent dispenser (e.g., through the removed portion of the upper wall) may be unable to completely remove detergent that is trapped within area 79 behind portion 77 of the wall 59. For example, in some embodiments, areas (e.g., area 77) that cause detergent to be caught may form when the removed portion of the upper wall defines a width of approximately 2 inches or less.

As shown in conjunction with FIGS. 11, 11A, 11B, and 11C, the reservoir 50 may have a rectangular cross section (taken along a plane generally parallel to the dispenser door and/or interior of the dishwasher door) and at least a portion of the wall 59 surrounding the reservoir is removed. However, it is understood that the reservoir 50 may have other shapes, such as triangular in other embodiments. Thus, different portions and amounts of the upper wall may be removed depending on the shape of the reservoir.

As such, an exemplary embodiment employs a width of the removed portion of the upper wall 59 is optimized such that the aforementioned drawbacks are minimized or eliminated. For example, the removed portion of the wall 59 may be between about 86-100% of the width of the reservoir. In one specific embodiment, the removed portion of the wall 59 is between about 2 and 2.3 inches, and the width of the reservoir is about 2.32 inches. According to one advantageous embodiment, the width of the removed portion is about 96% of the width of the reservoir 50 (e.g., about 2.23 inches for a reservoir having a width of about 2.32 inches).

Removing the upper wall also prevents the detergent dispenser 40 from providing a water tight seal when the dispenser door 41 is closed in some embodiments. Thus, as shown in FIG. 5, water is able to flow into the detergent dispenser 40 even with the dispenser door 41 closed. In the depicted embodiment, water can flow along line B over the top edge 46 of the detergent dispenser 40 and between the closed dispenser door 41 and the top edge 46. In addition, water flowing down the dishwasher door 18 may fall directly onto the lower slope 52 of the dispenser reservoir 50 to facilitate removal of detergent.

One potential advantage of encouraging water to enter the closed detergent dispenser 40 is that the enzymes in the detergent become active when wet and start a relatively short span of activity after becoming wet. Unexpectedly, testing has demonstrated that wash performance has improved by flooding the detergent reservoir 50 with water before opening the dispenser door 41 during the wash cycle. By wetting the detergent before opening the dispenser door 41, the enzymes are ready to consume soil types upon being released. In addition, flooding the detergent reservoir 50 may ensure that enzymes present in harder-to-dissolve tablets are available earlier in the main wash cycle and that they do not carry over into subsequent rinses. Often, consumers may use such tablets instead of powder or liquid detergent when filling the detergent reservoir 50 before operating the dishwasher.

Figure 7:
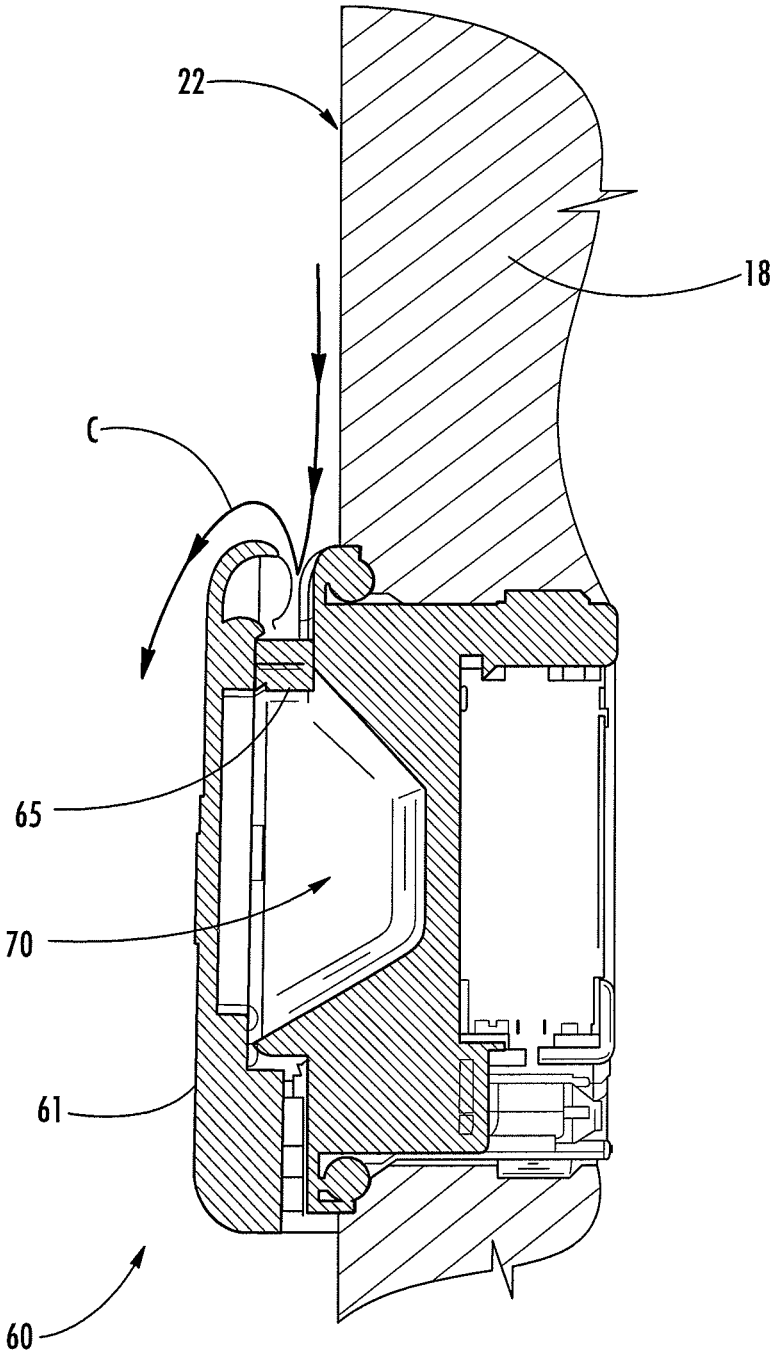
FIG. 7 is a cross-sectional side view of the detergent dispenser shown in FIG. 6 in a closed and sealed configuration in accordance with some embodiments discussed herein.
Figure 8:
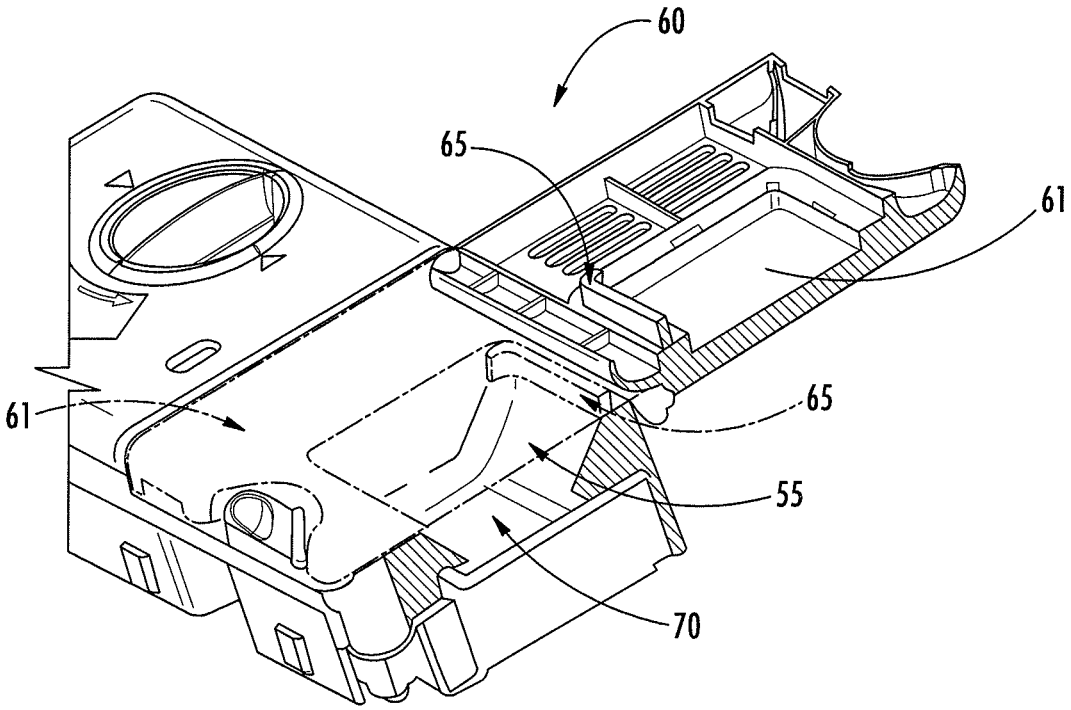
FIG. 8 is a cross-sectional perspective view of the detergent dispenser shown in FIG. 6 in an open configuration and also transparently illustrated in a closed configuration in accordance with some embodiments discussed herein.
Figure 9:
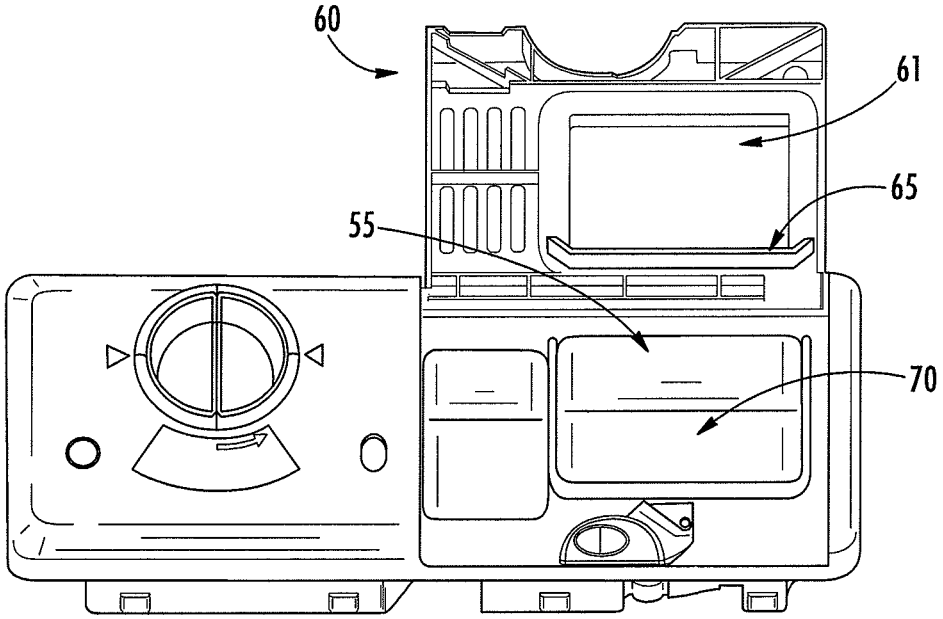
FIG. 9 is a perspective view of the detergent dispenser shown in FIG. 8 in an open configuration.

FIGS. 6-9 show another embodiment of the present invention. In the depicted embodiments, the detergent dispenser 60 is configured to achieve a water-tight seal when closed. The dispenser is also configured to encourage and/or direct water running down the dishwasher door 18 toward the dispenser reservoir 70 when the dispenser door 61 is open as discussed above. In the depicted embodiments, the detergent dispenser 60 comprises a dispenser reservoir 70 and a dispenser door 61. The dispenser door 61 also comprises a rib 65 or gasket extension coupled to a gasket 68 configured to engage with the dispenser reservoir 70 when the dispenser door 61 is closed to create a water-tight seal. Thus, as shown in FIG. 7, water running down the interior side 22 of the dishwasher door 18 (i.e., along line C) toward the closed detergent dispenser 60 is blocked from entering the dispenser reservoir 70 by the seal created by the rib 65. However, with reference to FIG. 6, once the dispenser door 61 is opened and the rib 65 is removed from engagement with the reservoir 70, the water is able to run down the dishwasher door to enter the dispenser reservoir 70 and remove the detergent.

When circumstances dictate that detergent must be kept dry until ready to dispense, a detergent dispenser that is configured to achieve a water-tight seal, like the detergent dispenser 60 shown in FIGS. 6-9, can be used. This avoids the detergent from becoming prematurely moist, clumping, and hardening, thereby becoming difficult to remove and increasing the likelihood that the detergent in solution will bleed out from the top of the dispenser reservoir 70.

In other embodiments, as shown in FIG. 10, the detergent dispenser 80 may also comprise an upper sloped surface 55. The upper slope 55 is angled to utilize the cohesive nature of water running into the dispenser reservoir 90, encouraging and directing water to sweep the back and lower surfaces of the dispenser reservoir 90. In some embodiments, the upper slope 55 is optimally set such that when the dishwasher door 18 is in the closed configuration, gravity encourages water to enter the detergent dispenser 80, having followed the interior surface 22 of the dishwasher door 18 and the contoured frame of the detergent dispenser 80 into the reservoir 90, and to travel toward the bottom of the detergent reservoir 90 while adhering to the back wall of the reservoir 90 rather than separating into drops and falling directly to the lower slope 92 of the detergent reservoir 90. Thus, water running along line D will be encouraged by the upper slope 55 to run further into the dispenser reservoir 90, encountering a greater amount of detergent for increased removal. Thus, the reservoir 90 may include both an upper slope 55 and a lower slope 92 for facilitating removal of the detergent during a wash cycle.

Another embodiment of the present invention is a method for operating a dishwasher and removing detergent from a detergent dispenser attached to a surface of a dishwasher door. The method may comprise steps to remove detergent from a detergent dispenser in accordance with any of the embodiments of the present invention as described herein. In one example embodiment, the method comprises providing a dishwasher comprising a tub and a door hingedly connected to the tub and configured to pivot between an open position and a closed position, wherein the door further comprises an interior surface configured to face the tub when the door is in the closed position. The dishwasher further comprises at least one spray arm configured to provide water within the tub and a detergent dispenser positioned on the interior surface of the door and comprising a reservoir configured to hold detergent, wherein a portion of the upper wall of the detergent reservoir has been removed such that water flowing down the dishwasher door is encouraged into the reservoir. The method further comprises configuring the dishwasher such that in operation water provided to the tub through the at least one spray arm flows down the interior surface of the dishwasher door and is encouraged into the reservoir.

Embodiments of the present invention, as described herein, improve the likelihood that detergent will be released from the detergent dispenser. Providing an additional path for water to enter the dispenser reservoir can reduce the time necessary to move the detergent into the wash area or tub. Further, allowing water to sweep the back and lower surface of the reservoir assures that trace amounts of detergent are removed, resulting in all of the intended detergent being applied to the wash load, and assuring the user a clean and available reservoir for placing detergent for the next wash load. Also, providing a water source that is independent of spray arm jets removes the possibility that the user, by loading the racks in an unfavorable manner, will prevent the detergent from being released properly, thereby resulting in greater rack loading flexibility. With improved detergent release, a user can expect improved soil removal, less spotting of dishes, and a lower chance for detergent contamination or residue on cleaned dishware.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A dishwasher comprising:

a tub defining a top and a bottom;

a door hingedly connected to the tub and configured to pivot between an open position and a closed position, wherein the door further comprises an interior surface configured to face the tub when the door is in the closed position;

at least one spray arm configured to provide water within the tub; and a detergent dispenser defining a top and a bottom, wherein the detergent dispenser is positioned on the interior surface of the door such that the top of the detergent dispenser is configured to generally face the top of the tub when the door is in the closed position, wherein the detergent dispenser comprises:

a reservoir configured to contain detergent therein; and a wall extending outwardly from the reservoir and at least partially around the reservoir, wherein at least a portion of the wall proximate the top of the detergent dispenser is removed to reduce a cross-sectional length thereof such that water flowing down the interior surface of the dishwasher door is encouraged into the reservoir.

2. The dishwasher according to claim 1, wherein the detergent dispenser further comprises a dispenser door configured to move between a closed configuration and an open configuration, wherein the dispenser door is further configured to cover the reservoir in the closed configuration, and wherein the detergent dispenser is configured to encourage water flowing down the interior surface of the door into the reservoir when the dispenser door is in the open configuration.

3. The dishwasher according to claim 1, wherein the detergent dispenser further comprises a dispenser door configured to move between a closed configuration and an open configuration, wherein the dispenser door is further configured to cover the reservoir in the closed configuration, and wherein the detergent dispenser is configured to encourage water flowing down the interior surface of the door into the reservoir when the dispenser door is in the closed configuration.

4. The dishwasher according to claim 1, wherein the dispenser further comprises a curved surface extending at least partially between the interior of the dishwasher door and the reservoir and configured to encourage water flowing down the interior surface of the door into the detergent dispenser.

5. The dishwasher according to claim 1, wherein the detergent dispenser further comprises a dispenser door configured to move between a closed configuration and an open configuration, wherein the dispenser door is further configured to cover the reservoir in the closed configuration to create a water-tight seal therebetween.

6. The dishwasher according to claim 5, wherein the dispenser door comprises a rib configured to engage the dispenser reservoir in the closed configuration to create a water-tight seal therebetween and disengage the dispenser reservoir in the open configuration to allow water flowing down the interior surface of the door to enter the dispenser reservoir.

7. The dishwasher according to claim 1, wherein the reservoir comprises a sloped upper surface configured to encourage water into the reservoir and a sloped lower surface configured to encourage detergent out of the reservoir.

8. The dishwasher according to claim 1, wherein the reservoir defines a width and the removed portion of the wall defines a width, and wherein the width of the removed portion of the wall is less than the width of the reservoir.

9. The dishwasher according to claim 8, wherein the removed portion of the wall defines a width between about 86-100% of the width of the reservoir.

10. The dishwasher according to claim 8, wherein the removed portion of the wall defines a width between about 2 and 2.3 inches.

11. The dishwasher according to claim 8, wherein the wall comprises a pair of radial edges, the radial edges disposed on opposite sides of the reservoir from one another, and wherein the width of the removed portion extends between the radial edges.

12. A detergent dispenser for a dishwasher, wherein the dishwasher comprises a tub defining a top and a bottom and a door defining an open position and a closed position, wherein the detergent dispenser defines a top and a bottom, wherein the detergent dispenser is configured to be positioned on an interior surface of a door of the dishwasher such that the top of the detergent dispenser is configured to face the top of the tub of the dishwasher when the door is in the closed position, wherein the detergent dispenser comprises:

a reservoir configured to contain detergent therein; and a wall extending outwardly from the reservoir and at least partially around the reservoir, wherein at least a portion of the wall proximate the top of the detergent dispenser has been removed to reduce a cross-sectional length thereof such that water flowing down an interior surface of the dishwasher door is encouraged into the reservoir.

13. The detergent dispenser according to claim 12 further comprising a dispenser door configured to move between a closed configuration and an open configuration, wherein the dispenser door is configured to cover the reservoir in the closed configuration, and wherein the detergent dispenser is configured to encourage water flowing down the interior surface of the dishwasher door into the reservoir when the dispenser door is in the open configuration.

14. The detergent dispenser according to claim 12 further comprising a dispenser door comprising a closed configuration and an open configuration, wherein the dispenser door is configured to cover the reservoir in the closed configuration, and wherein the detergent dispenser is configured to encourage water flowing down the interior surface of the dishwasher door into the reservoir when the dispenser door is in the closed configuration.

15. The detergent dispenser according to claim 12, wherein the reservoir comprises a sloped upper surface configured to encourage water into the reservoir.

16. A method comprising:

providing a dishwasher comprising:

a tub defining a top and a bottom;

a door hingedly connected to the tub and configured to pivot between an open position and a closed position, wherein the door further comprises an interior surface configured to face the tub when the door is in the closed position;

at least one spray arm configured to provide water within the tub; and positioning a detergent dispenser defining a top and a bottom on the interior surface of the door such that the top of the detergent dispenser is configured to generally face the top of the tub when the door is in the closed position, wherein the detergent dispenser comprises a reservoir configured to hold detergent and a wall extending outwardly from the reservoir and at least partially around the reservoir, wherein at least a portion of the wall proximate the top of the detergent dispenser has been removed to reduce a cross-sectional length thereof such that, during operation of the dishwasher, water flowing down the interior surface of the dishwasher door is encouraged into the reservoir.

17. The detergent dispenser according to claim 12, wherein the dispenser further comprises a curved surface extending at least partially between the interior of the dishwasher door and the reservoir and configured to encourage water flowing down the interior surface of the door into the detergent dispenser.

18. The detergent dispenser according to claim 12 further comprising a dispenser door configured to move between a closed configuration and an open configuration, wherein the dispenser door is further configured to cover the reservoir in the closed configuration to create a water-tight seal therebetween.

19. The detergent dispenser according to claim 18, wherein the dispenser door comprises a rib configured to engage the dispenser reservoir in the closed configuration to create a water-tight seal therebetween and disengage the dispenser reservoir in the open configuration to allow water flowing down the interior surface of the door to enter the dispenser reservoir.

20. The detergent dispenser according to claim 12, wherein the reservoir defines a width and the removed portion of the wall defines a width, and wherein the width of the removed portion of the wall is less than the width of the reservoir.

* * * * *